United States Patent [19]

Kingsley et al.

[11] 4,203,401

[45] May 20, 1980

[54] EVAPORATIVE EMISSIONS CANISTER

[75] Inventors: Charles A. Kingsley, Sterling Heights; James R. Spaulding, Troy, both of Mich.; William E. Gifford, Spencerport, N.Y.

[73] Assignee: General Motors Corporation, Detroit, Mich.

[21] Appl. No.: 7,490

[22] Filed: Jan. 29, 1979

[51] Int. Cl.[2] ..... F02M 37/00; F02M 33/02

[52] U.S. Cl. ..... 123/136; 123/DIG. 2; 55/387

[58] Field of Search ..... 123/136, DIG. 2, 198 R, 123/119 B; 55/387; 210/188, 189

[56] References Cited

U.S. PATENT DOCUMENTS

| | | | |
|---|---|---|---|
| 3,678,663 | 7/1972 | Hansen | 55/387 |
| 3,683,597 | 8/1972 | Beveridge | 123/136 |
| 3,913,545 | 10/1975 | Haase | 123/136 |
| 4,058,380 | 11/1977 | King | 123/136 |
| 4,137,882 | 2/1979 | Thornburgh | 123/136 |
| 4,149,504 | 4/1979 | Walters | 123/136 |

FOREIGN PATENT DOCUMENTS

| | | | |
|---|---|---|---|
| 2346623 | 4/1974 | Fed. Rep. of Germany | 123/136 |

OTHER PUBLICATIONS

1978 Buick Chassis Service Manual, Buick Motor Division, General Motors Corp., Flint, Mich., 1977.

*Primary Examiner*—Charles J. Myhre
*Assistant Examiner*—Carl Stuart Meller
*Attorney, Agent, or Firm*—Arthur N. Krein

[57] ABSTRACT

An evaporative emission canister, for use with the fuel system for an internal combustion engine, includes a canister housing defined by a cylindrical outer wall, a closed lower end wall, an upper end wall and a cylindrical inner wall depending from the upper end wall. An air-vapor permeable support means is positioned within the housing above the lower end wall in abutment against the lower free end of the inner wall to define with the lower end wall an air chamber in flow communication with the atmosphere and to define with the outer wall and the inner wall, an outer canister chamber and an inner canister chamber, respectively, that contain fuel vapor adsorbing material. The inner canister chamber is connected by a fuel bowl vent valve so as to receive vapors emitted from the float bowl of the carburetor of the engine when the engine is not in operation and the outer canister chamber is connected to receive vapors emitted from the fuel in the fuel tank for the engine. First and second orifice passages from the inner and outer canister chambers, respectively, are connected to the vapor purge chamber of a vapor purge control valve whereby fuel vapors can be purged from the canister assembly to the engine during engine operation. In the preferred embodiment, the above-described valves are incorporated into the upper end wall of the canister.

3 Claims, 9 Drawing Figures

EVAPORATIVE EMISSIONS CANISTER

FIELD OF THE INVENTION

This invention relates to evaporative emission control systems for internal combustion engines and, in particular, to an evaporative emission canister for use in such a system to control the loss of fuel vapor from the engine fuel system of a motor vehicle.

DESCRIPTION OF THE PRIOR ART

In recent years, most vehicles had been equipped with an evaporative emission control or fuel vapor recovery system of the type shown, for example, in U.S. Pat. No. 3,683,597 entitled "Evaporation Loss Control" issued Aug. 15, 1972 to Thomas R. Beveridge and Ernst L. Ranft. In such a system, a vapor storage canister is used to receive and store fuel vapors emitted from the engine fuel system. In particular, these fuel vapors are received from the fuel tank for the engine and from the fuel bowl of the carburetor, if the latter is used on the engine. Such canisters contain a vapor adsorbent media, such as activated charcoal. By means of suitable conduits and appropriate flow control valves, the canister is adapted to receive fuel vapors emitted from the fuel tank and from the float bowl and to store these vapors such that during engine operation, the stored fuel vapors can be purged from the canister into the engine induction system for consumption within the engine.

In the cycle between engine operations, the greatest quantity of fuel vapor is emitted from the fuel bowl during the hot soaked condition, a condition which occurs immediately after engine shut-down. On the other hand, vapors are emitted from the fuel tank to the canister as a result of diurnal losses. It has now been found that, in the known canister constructions, since the fuel vapors from the fuel bowl are the first to be discharged into the adsorbent material of the canister and then at a later period additional fuel vapors flow to the canister from the fuel tank, this later flow of fuel vapors from the fuel tank can cause back purge of vapors from the canister. That is, in effect, vapors will be caused to overflow from the canister into the atmosphere through the passage or passages of the canister that are provided for the normal admission of atmospheric air into the canister to effect purging of the fuel vapors therefrom.

Accordingly it is a primary object of this invention to provide an improved evaporative emissions canister of a structural arrangement whereby such canister is operative to prevent the back purge of fuel vapor therefrom to the atmosphere.

Another object of this invention is to provide an improved evaporative emissions canister by the incorporation therein of an inner canister and a cylindrical outer canister in a unitary structure wherein separate vapor conduits to these canister portions are used to deliver fuel vapors thereto and wherein separate purge orifices from these canister portions are used for the controlled purging of fuel vapors therefrom via a common purge valve.

For a better understanding of the invention, as well as other objects and further features thereof, reference is had to the following detailed description of the invention to be read in connection with the accompanying drawings, wherein:

Figure 1:
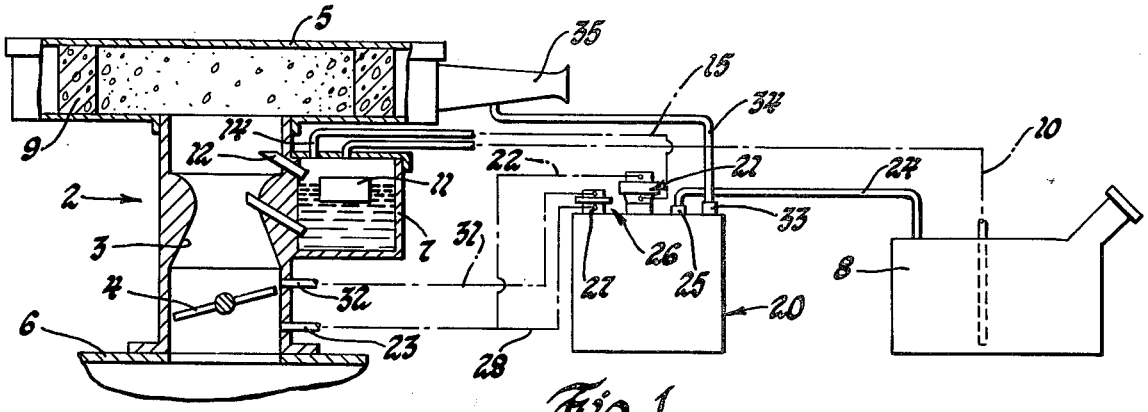
FIG. 1 is a schematic view of a portion of the fuel vapor recovery system for an internal combustion engine, the vapor recovery system having an evaporative emission canister, in accordance with the invention, incorporated therein.

Referring first to FIG. 1, an internal combustion engine, not shown, has an induction system including a carburetor 2 having an induction passage 3 therethrough with flow through the induction passage controlled by a movable throttle valve 4. As is conventional, an air cleaner 5 is mounted on the carburetor 2. Induction fluid flowing through the induction passage 3 is delivered to an intake manifold 6 used to supply induction fluid to the combustion cylinders, not shown, of the engine. Carburetor 2 is provided with a conventional fuel bowl 7 used for the delivery of fuel, in a conventional manner into the induction passage 3. Fuel is supplied to the fuel bowl 7 from a fuel tank 8, through a fuel line 10 in a conventional manner. The level of fuel in the fuel bowl 7 is controlled by a suitable float bowl valve 11, in a conventional manner, not shown.

The carburetor 2 is provided with an internal vent passage 12 which extends at one end from the upper portion of the fuel bowl to open at its other end either into the interior of the air cleaner 5, on the clean side of the air filter 9 therein, or directly into the induction passage 3, as shown, whereby fuel vapors from the fuel bowl are delivered into the induction fluid being delivered to the combustion chambers of the engine during engine operation.

The carburetor 2 is also provided with an external vent passage 14, which opens at one end into the interior of the fuel bowl 7 at a position above the level of fuel therein, the opposite end of this passage being connected as by a conduit 15 to an evaporative emission canister 20, constructed in accordance with the invention, to be described hereinafter. Delivery of the fuel vapor through the conduit 15 to the canister 20 is controlled by canister fuel bowl vent valve 21.

The fuel bowl vent valve 21 may be of suitable type, and as shown, and described in detail hereinafter, is of the type having a diaphragm actuated valve that is operative to prevent vapor flow from the fuel bowl 7 through the conduit 15 into the canister 20 during engine operation. For this purpose, the vacuum control chamber of the fuel bowl vent valve 21 is connected by a conduit 22 to a source of intake manifold vacuum, such as by being connected to a port 23 opening into the induction passage 3 downstream of throttle 4.

Fuel tank 8 has at least one vent line 24 extending therefrom to an intake fitting 25 of the canister 20 whereby fuel vapors emitted from the fuel stored therein can be delivered to the canister for storage therein.

Purging of fuel vapor from the evaporative emission canister 20 is controlled by a purge valve 26 in a manner to be described in detail hereinafter. In the construction of the purge valve 26 shown, it is provided with a vapor outlet fitting 27 which is connected through a purge line 28 to the engine induction passage 3. The purge line 28 in the construction shown schematically in FIG. 1, is suitably connected as by a T-fitting to the conduit 22 connected to the port 23, as previously described. A diaphragm actuated valve, to be described in detail hereinafter, positioned within the purge valve 26 is used to control the purge rate of fuel vapors from the canister during engine operation as a function of engine operation. For this purpose, a fitting 30 of the purge valve 26 is connected by a vacuum conduit 31 extending to the induction passage 3 at a port 32. Port 32 is located upstream from the throttle 4 which the throttle is closed and is traversed by the throttle 4 as the throttle is opened. Port 32 is thereby subjected to the vacuum condition below throttle 4 during open throttle operation.

An air fitting 33 on canister 20 is connected by an air line 34 to receive atmospheric air whereby to effect purging of fuel vapors from the canister. The air conduit 34 can be connected to the snorkel 35 of the engine air cleaner 5, as shown, but preferably it is connected to the air cleaner 5 on the downstream side of the air filter 9 therein.

Figure 2:
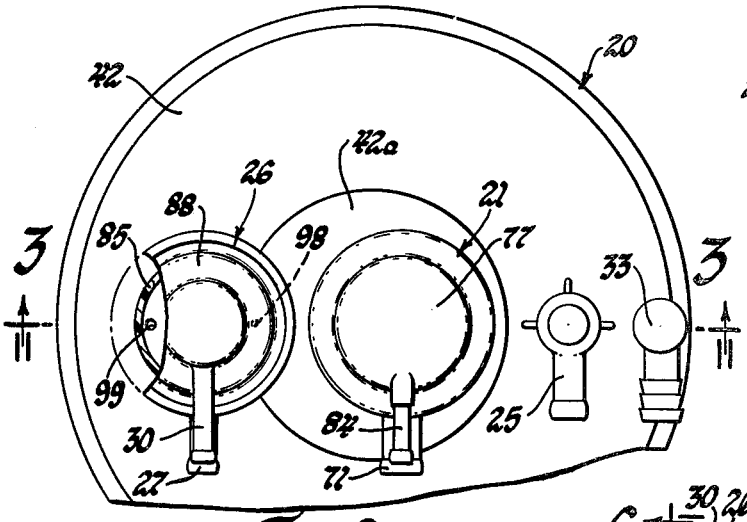
FIG. 2 is a top view of a first embodiment of an evaporative emission canister in accordance with the invention.
Figure 3:
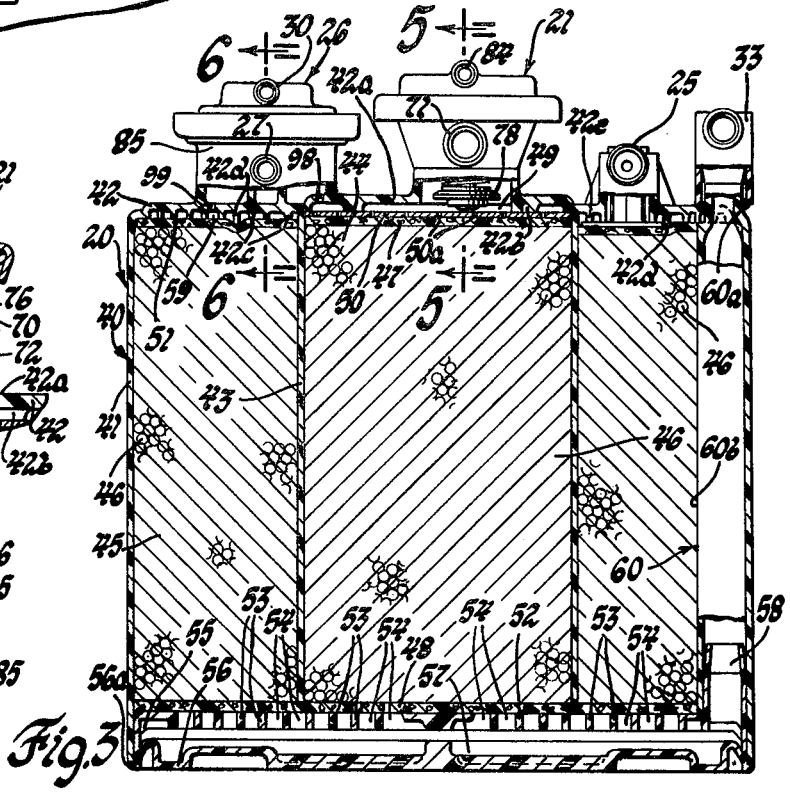
FIG. 3 is a longitudinal, cross-sectional view of the evaporative emission canister of FIG. 2 taken along 3—3 of FIG. 2.

Referring now to the evaporative emission canister 20 of the invention in accordance with the embodiment shown in FIGS. 2 to 8, this canister 20, as best seen in FIG. 3, includes a housing 40, for example, molded from heat stabilized nylon. Housing 40 includes a generally cylindrical side wall 41 that depends from a circular upper end wall 42. End wall 42, as best seen in FIGS. 2 and 3, includes a central raised circular wall portion 42*a*, for a purpose to be described hereinafter, which is located concentrically with the side wall 41, in the construction shown. Also depending from the end wall 42 is a cylindrical inner side wall 43. The inner side wall 43 depends from the end wall 42 at a location next adjacent to the outer peripheral edge of the raised portion 42*a* of this end wall. The opposite end of the inner side wall 43 extends a predetermined axial extent within the exterior side wall 41 so that the lower end of this inner side wall terminates a predetermined short distance from the end of the side wall 41 for a purpose which will become apparent.

The cylindrical inner side wall 43 thus serves as a cylindrical partition wall to divide the body 40 into an inner canister chamber 44 partly enclosed by the inner side wall 43 and an annular outer canister chamber 45 as defined by the interior surface of the side wall 41 and the outer peripheral surface of the inner side wall 43. A body of fuel vapor adsorbent material, such activated carbon 46, is retained in the inner canister chamber 44 between a central porous upper pad 47 at the top of the canister and a porous lower pad 48 at the bottom of the canister body.

As shown in FIG. 3, the upper pad 47 is in a form of a circular disc of a suitable diameter whereby it is slidably received within the cavity defined by the interior surface of the inner side wall 43. The upper pad 47 is positioned at the top of the canister housing 40 to abut against one side of an upper perforated grid disc 50, the opposite side of the disc 50 abutting against the lower surface of the depending, circumferentially spaced apart ribs 42*b* of the raised portion 42*a* of end wall 42, as best seen in FIG. 3. As seen in this Figure, the perforated disc 50, with a plurality of radially and circumferentially spaced apart arcuate thru apertures 50*a* therein, is of a diameter whereby it is slidably received within the side wall 43. Perforated disc 50 as thus spaced from the lower surface of the raised portion 42*a* of the end wall 42 forms with the raised portion 42*a* an upper, circular vapor chamber 49.

Another body of fuel vapor adsorbent material, such as activated carbon 46, is retained in the outer canister chamber 45 between a porous annular upper pad 51 and the lower pad 48. As seen in FIG. 3, the lower pad 48 is of a diameter so as to be received within the side wall 41 to serve as the lower support pad for both the inner and outer canister chambers 44 and 45, respectively.

As seen in FIG. 3, the end wall 42 radially outboard of its raised portion 42*a* is provided with radially, spaced apart, non-continuous depending arcuate ribs 42*c* defining a labyrinth or maze. In addition, this portion of end wall 42 is also provided with a single eccentric rib 42*d*, that extends below the ribs 42*c*.

Annular upper pad 51 is positioned in the housing body 40 so as to abut against the ribs 42*c* and 42*d* whereby to form with the lower surface of the end wall 42 an upper, annular, labyrinth like vapor chamber 59. As shown in FIG. 3, rib 42*d* is positioned so as to separate vapor chamber 59 into, in effect, two sections, one for purge and one for tank vapor inlet. That is, vapor chamber 59 is divided into a section in flow communication with intake fitting 25 and a section in communication with a purge orifice 99, both to be described in greater detail hereinafter.

The pads 47, 51 and 48 are made, for example, of a suitable material, such as a polyurethane foam material, whereby these pads are sufficiently porous to permit the flow of fuel vapor and air therethrough, the pad 48 is thus also adapted to serve as an air filter, as will become apparent. These pads are used as compression members whereby the adsorbent material 46 can be suitably biased or compressed into a tightly packed condition between pad 47 and pad 48 and between pad 51 and pad 48 so as to prevent movement of the adsorbent material.

The lower pad 48 is supported within the lower end of the body 40 by means of a perforated substantially circular air inlet grid 52. This inlet grid 52, which may also be molded of heat stabilized nylon, has a gridded structure defined by a plurality of spaced apart circular ribs 53 and a plurality of radially extending ribs 54 arranged so as to provide a plurality of arcuate openings extending through the grid from its lower surface to its upper surface.

A sealing lip 55, in the form of an annular flange depending from the grid 52, is resiliently biased outward, as originally formed, whereby to sealingly engage the inner peripheral surface of the side wall 41.

This sealing lip 55 is also used to support the perforated main portion of grid 52 in raised axially spaced apart relation relative to a bottom cover 56. In the construction shown, the lower edge of the sealing lip 55 is positioned within the housing 40 so as to abut against the upper surface of the bottom cover 56 radially inward of its outer peripheral edge.

Bottom cover 56, which may also be molded of heat stabilized nylon, is suitably fixed to the body 40 so as to enclose the lower end thereof. In the construction shown, the lower rim edge surface of end wall 42 abuts against the upper edge of an upward rolled-over outer rim 56*a* of the bottom cover 56 and is secured thereto as by welding. With the grid 52 thus supported by the bottom cover 56, the lower pad 48 is positioned so as to abut against the lower rim edge surface of the inner side wall 43, for a purpose which will become apparent.

The space between the lower surface of the air inlet grid 52 and the upper surface of the bottom cover 56 defines a common air chamber 57 that is in the flow communication with both the inner and outer canister chambers 44 and 45, respectively. To permit the entry of air into the air chamber 57, the grid 52, in the construction shown is provided, with an air inlet tube 58, preferably formed integral therewith, that is located adjacent to the outer peripheral edge thereof in position so as to be telescopically received in the lower end of a vertical air tube 60 that extends down through the housing body 40. Air tube 60, also preferably formed integral with the body 40 as shown, is provided with an upper portion 60*a* that extends upward from the end wall 42 and a lower portion 60*b* that extends downward from the end wall 42 to terminate closely adjacent to air inlet grid 52. In the construction shown, the lower portion 60*b* of tube 60 is formed integral with the side wall 41.

The air inlet fitting 33, which in the construction shown, is in the form of an elbow fitting, is secured at one end to the upper portion 60*a* of tube 60 and is connected at its other end by the air conduit 34, in the manner described, whereby air, at substantially atmospheric pressure, can be supplied via the tube 60 and tube 58 into the air chamber 57.

Figure 4:
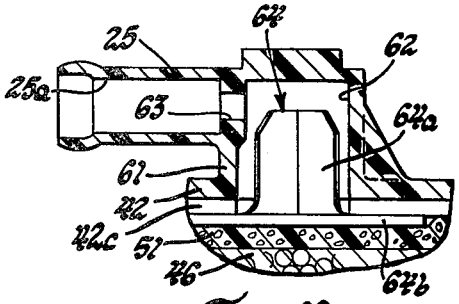
FIG. 4 is a cross-sectional view of the canister tank vapor inlet fitting which is adapted for connection to the fuel tank.

Fitting 25 used for connecting the fuel tank 8 to the canister 20 via the vent line 24, is formed as an integral part of an upright boss 61 formed on the end wall 42. As best seen in FIG. 4, boss 61 is provided with a vertical bore passage 62 that communicates at one end via vapor chamber 59 with the outer canister chamber 45. Bore passage 62 adjacent to its other end communicates with a vapor vent orifice 63 of predetermined cross-sectional flow area that opens into the horizontal passage 25*a* provided by fitting 25. A defuser 64, having a crown portion 64*a*, when viewed from above, is press fitted into bore passage 62 so that its flanged base 64*b* is positioned to abut against the lower surfaces of ribs 42*c*. The defuser 64 is operative to cause fuel vapors entering through the passage 25 and vapor vent orifice 63 to flow radially outward relative to the bore passage 62 into the annular vapor chamber 59.

Figure 5:
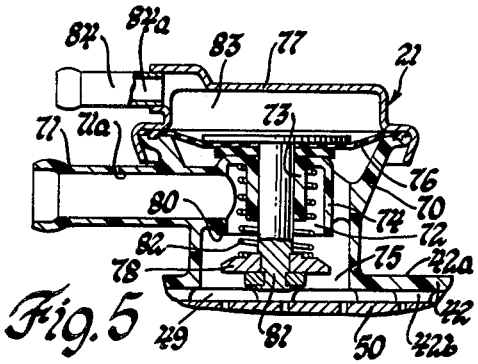
FIG. 5 is a cross-sectional view taken along 5—5 of FIG. 3 to show details of the canister fuel bowl vent valve.

Referring now to FIGS. 2, 3 and 5, the fuel bowl vent valve 21, in the construction shown, includes a body 70 formed integral with end wall 42. The body 70 includes a fitting 71 with a passage 71*a* therethrough that opens into an annular chamber 72 within the body 70. As shown, the chamber 72 is formed by concentric depending tubes 73 and 74 interconnected at their upper ends. Chamber 72 at one end thereof is thus in flow communication with a lower chamber 75 that opens at one end into the vapor chamber 49 between the lower surface of the raised portion 42*a* of end wall 42 and the upper surface of the grid disc 50. Chamber 75 at its other end extends to beneath a diaphragm 76 secured by a cover 77 to the upper rim of body 70.

Flow between the chamber 75 and chamber 72 is controlled by a valve 78 that is positioned for movement between an open position and a closed position relative to a valve seat 80 at the lower end of the tube 74 encircling the lower end of chamber 72. Valve 78 is suitably fixed to the lower end of a valve stem 81 that is slidably received in the inner tube 73. The opposite end of this valve stem 81 is fixed to the diaphragm 76 for movement therewith. A spring 82, of predetermined force, positioned to encircle the valve stem 81, is operative to normally bias the valve 78 to its open position relative to the valve seat 80, the position shown in FIG. 5. Thus the fuel bowl vent valve 21 is a normally open valve.

The cover 77 forms with the upper surface of diaphragm 76 a vacuum control chamber 83. Cover 77 is provided with a fitting 84, having a passage 84*a* therethrough, for connection via the conduit 22 to the induction passage 3 downstream of the throttle valve 4, whereby an induction vacuum signal can be applied to the vacuum chamber 83 during engine operation.

Thus during engine operation, when the vacuum signal thus applied is sufficient to overcome the bias of the spring 82, the valve 78 is lifted to its closed position, at which it is seated against valve seat 80 to block flow of fuel vapor through the passage 71*a* and chamber 72 into the chamber 75. At that time, venting of fuel vapors from the fuel bowl 7 will the occur via the internal vent 12 into the induction passage 3 whereby fuel vapors thus emitted in the fuel bowl are consumed within the engine. When the engine is not operating, vapors from the fuel bowl 7 will flow via external vent 14 through the fuel bowl vent valve 21 into the inner canister chamber 44, since at that time the spring 82 will hold the valve 78 in its open position. With this arrangement, venting of fuel vapors from the fuel bowl is via the internal vent 12 during engine operation and, when the engine is not in operation, the fuel vapors are vented via the external vent 14 for storage in the inner canister chamber 44 of the evaporative emission canister 20.

Figure 6:
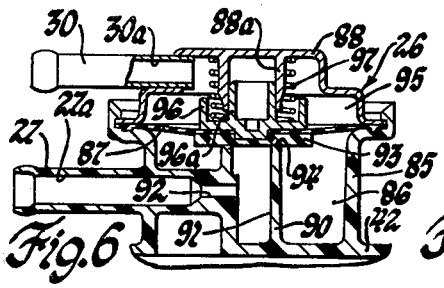
FIG. 6 is a sectional view taken along 6—6 of FIG. 3 showing details of a first embodiment canister purge valve of the canister of FIG. 2.

Referring now to FIGS. 2, 3 and 6, the purge valve 26 has its base 85, in the construction shown, formed integral with the end wall 42 of the canister body 40. This base 85 with the upper surface of end wall 42 defines a vapor purge chamber 86 one side of a diaphragm 87 that is sandwiched between the upper rim of the base 85 and a cover 88 suitably secured thereto. A central boss 90 within the base 85 extends upward from the end wall 42 into the chamber 86. A blind bore extends from the upper end of this boss 90 to define a passage 91 which is in flow communication via a restricted main purge orifice passae 92 with the horizontal passage 27*a* in the fitting 27. In the construction shown, the fitting 27 is formed integral with the base 85.

Flow from the chamber 86 to the passage 91 is controlled by a valve member 93 fixed to the lower side of the diaphragm 87 whereby the valve member is movable between an open position and a closed position relative to a valve seat 94 on the upper end of boss 90 encircling the upper end of passage 91. The diaphragm 87 forms with the cover 88 a vacuum chamber 95 which is in flow communication via the passage 30*a* through the fitting 30 and the conduit 31 to the ported vacuum from port 32.

As shown, the central portion of the diaphragm 87 is suitably secured in sandwiched relationship between the valve member 93 on one side thereof and a circular retainer 96 on the opposite side thereof. It will be apparent that, if desired, diaphragm 87 and valve member 93 may be formed as an integral part. Retainer 96 is provided with a central, upright cylindrical guide portion 96*a* that is slidably received in the guide bore of the depending cylinder guide 88*a* of the cover 88. A valve spring 97, of a predetermined force, located in the vacuum chamber 95 is positioned so as to normally bias the valve member 93 to its closed position, the position shown in FIG. 6.

Flow communication between the chamber 86 of the purge valve 26 and the vapor chamber 49 above the inner canister chamber 44 is via a purge orifice passage 98, of predetermined size, that extends through the raised portion 42*a* of the end wall 42, while the flow communication between the chamber 86 and the vapor chamber 59 above the outer canister chamber 45 is via a purge orifice passage 99, also of predetermined size, that extends through the end wall 42, as seen in FIGS. 2 and 3. The purge orifice passages 98, 99 in the construction shown, are located diametrically opposite each other as seen in FIGS. 2 and 3. Each of the purge orifice passages 98, 99 is sized, as desired, so as to control the purge rate from the inner and outer canister chambers 44 and 45, respectively.

Since the volume capacity of the outer canister chamber 45 would normally be greater than that of the inner canister chamber 44, the cross-sectional flow area of the purge orifice passage 99 would normally be greater than that of the purge orifice passage 98. For example, in a particular embodiment the diameter of purge orifice passage 99 was 2.00 to 2.10 mm while the diameter of purge orifice passage 98 was 0.73 to 0.79 mm. In this same embodiment, the volume capacity of the inner and outer canister chambers 44 and 45, respectively, was 500 cc and 2000 cc, respectively, and the diameter of the main purge orifice passage 92 was 2.10 to 2.20 mm. It will thus be apparent that the main purge orifice passage 92 is used to control the flow rate of the air-vapor from passage 91 and chamber 86, while the orifice passages 98 and 99 control flow only into the chamber 86 from the inner and outer canister chambers 44 and 45, respectively. Thus it will be apparent, depending on the engine application, that either the inner canister chamber 44 or the outer canister chamber 45 can be purged more rapidly than the other, simply by appropriate sizing of their respective purge orifice passages.

It will be apparent that the purge valve 26 is a normally closed valve to prevent flow of air and fuel vapors from the canister 20 to the engine. However, during engine operation, when the port 32 is subjected to the vacuum conditions below throttle valve 4 during open throttle conditions, the pressure differential across the diaphragm 87 will be sufficient to overcome the bias of spring 97 to effect movement of the valve member 93 to its open position. At the same time, the vacuum from port 23 induces air flow through air conduit 34, air fitting 33, tubes 60 and 58 into air inlet chamber 57. Air from air inlet chamber 57 will then flow through the inner and outer canister chambers 44 and 45, respectively to purge fuel vapor from the adsorbent material 46 in each of these chambers. The air-vapor mixture flowing from the canister 20 via the purge valve 26, as controlled thereby is then delivered into the induction passage 3 for consumption within the engine.

With the canister 20 structure shown, back purge or vapor overflow from the canister is substantially reduced, as compared to known prior art canister structures. This is because after engine shut-down, during the hot soak period fuel vapors emitted from the fuel in the float bowl 7 will flow to and be adsorbed by the adsorbent material in the inner canister chamber 44. This inner canister chamber 44, as seen in FIG. 3, is separated from the outer canister chamber 45 by the partition provided by inner side wall 43 so that communication between these chambers, at the ends opposite the vapor inlets thereto, is via the air inlet chamber 57. Therefore, as vapors are later emitted from the fuel tank 8 to the canister 20 as a result of diurnal losses, these vapors will flow only into the separate outer canister chamber 45 and thus this forced vapor flow cannot induce a back purge of fuel vapors from the inner canister chamber 44.

It will now be apparent to those skilled in the art, that although the partition wall in the form of inner side wall 43, in the preferred embodiment illustrated, is shown as extending downward so as to abut against the pad 48 used to define a common bottom for both inner and outer canister chambers 44 and 45, respectively, this partition wall need only extend sufficiently downward, as desired in a particular embodiment to as to prevent back purge of fuel vapors from one canister chamber for example, the inner canister chamber, as fuel vapors are discharged into the other canister chamber. Accordingly, the necessary axial downward extent of the partition wall will depend on the amount of fuel vapors emitted to the respective inner and outer canister chambers and the respective adsorbent volume capacity of each of these chambers relative to the fuel vapor quantities to be adsorbed therein.

Figure 7:
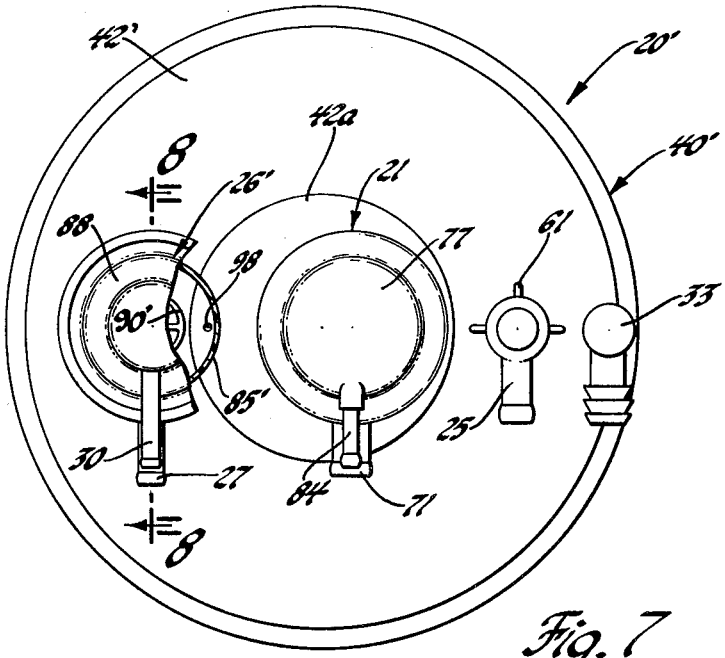
FIG. 7 is a top view of a preferred embodiment of an evaporative emission canister of the invention with a canister purge valve in accordance with a preferred embodiment incorporated therein.
Figure 8:
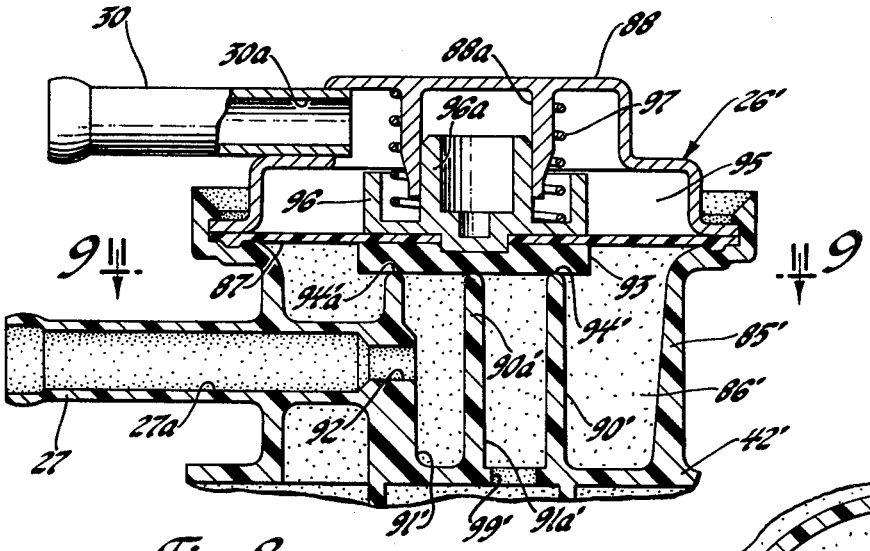
FIG. 8 is a sectional view taken along line 8—8 of FIG. 7 showing details of the canister purge valve of FIG. 7; and, FIG. 9 is a sectional view of the preferred embodiment canister purge valve taken along line 9—9 of FIG. 8.
Figure 9:
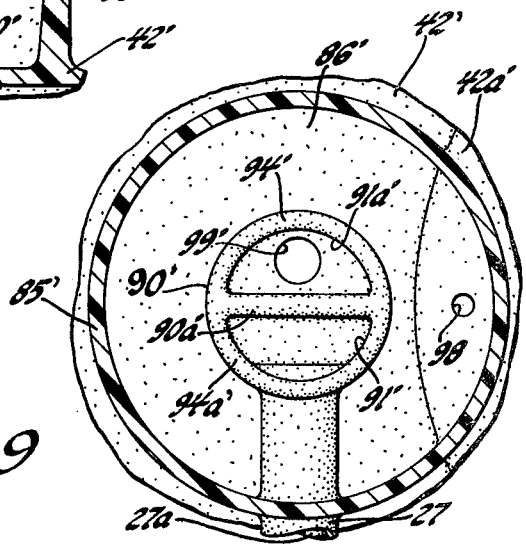

An alternate, preferred embodiment, of an evaporative emission canister, generally designated 20', in accordance with the invention is shown in FIGS. 7 to 9 wherein similar parts are designated by similar numerals but with the addition of a (') prime where appropriate.

The canister 20' is substantially identical to the canister 20, previously described, except for the use of a preferred embodiment of a canister purge valve 26' that is incorporated therein.

In the construction shown, the base 85' of this purge valve 26' is also preferably formed integral with the end wall 42' of the canister body 40' of canister 20'. This base 85' with the upper surface of end wall 42' defines a vapor purge chamber 86' on one side of the diaphragm 87 that is sandwiched between the upper rim of the base 85' and a cover 88 suitably secured thereto. A central boss 90' within the base 85' extends upward from the end wall 42' into the chamber 86'. Two blind bores extend from the upper end of this boss 90' to define a passage 91' and a passage 91*a'*. As best seen in FIG. 8, the passage 91' is in flow communication with the horizontal passage 27*a* in the fitting 27 via a restricted main purge passage 92. Also, as shown, the fitting 27 is preferably formed integral with the base 85'.

In this purge valve 26', the chamber 86' is placed in flow communication with the vapor chamber 49 above the inner canister chamber 44 of the canister 20' by means of a purge orifice passage 98, of predetermined size, that extends through the raised portion 42*a'* of the end wall 42'. In this preferred construction, flow communication from the vapor chamber 59 above the outer canister chamber 45 of the canister 20' is by means of a purge orifice passage 99', of predetermined size, that extends through the end wall 42' to open into the passage 91a'. Each of the purge orifice passages 98 and 99' is sized, as desired, so as to control the purge rate from the inner and outer chambers 44 and 45, respectively, of the canister 20'.

Both the flow from the chamber 86' to the passage 91' and the flow from the passage 91a' to the passage 91' is controlled by a valve member 93 fixed to the lower side of the diaphragm 87 whereby this valve member is movable between an open position and a closed position relative to the valve seats 94' and 94a' encircling the upper ends of the passages 91' and 91a'. The common partition wall 90a' of boss 90' that separates passage 91' from passage 91a' forms at its upper end surface a common portion of the valve seats 94' and 94a' as best seen in FIG. 9.

The diaphragm 87 forms with the cover 88 a vacuum chamber 95 that is in flow communication via the passage 30a in the fitting 30 and the conduit 31 to the ported vacuum from port 32. As shown, the remaining components of the purge valve 26' are similar to that of the purge valve 26 previously described. In addition, the operation of the purge valve 26' is similar to the operation of the purge valve 26 as previously described, except for the fact when the valve member 93 is seated against the valve seats 94' and 94a', as shown in FIG. 8, there can be no flow communication between the vapor chamber 49 via a purge orifice passage 98 to the vapor chamber 59 via the purge orifice passage 99'. Thus, this construction of the purge valve 26' will further reduce the possibility of back purge or vapor over flow from the canister 20'.

What we claim as new and desire to secure by Letters Patent of the United States is:

1. A fuel vapor storage canister for use with a motor vehicle engine and the fuel system therefor to control emission of fuel vapors, said canister including a housing defined by a cylindrical outer wall, a closed lower end wall and an upper end wall, an air-vapor permeable support means operatively positioned to peripherally abut said outer wall in axial spaced apart relation to said lower end wall to define therewith an air chamber; a cylindrical partition wall depending from said upper end wall to said support means to divide said housing above said support means into an inner canister chamber containing vapor adsorbent material located so as to provide a first vapor chamber adjacent said upper end wall and into an annular outer canister chamber containing vapor adsorbent material located so as to provide an annular second vapor chamber adjacent said upper end wall; air passage means operatively connected to said housing for supplying external atmospheric air to said air chamber; a first vent passage in said upper end wall to said first vapor chamber adapted for connection to the fuel bowl of the carburetor for the engine; a second vent passage in said upper end wall to said second vapor chamber adapted for connection to the fuel tank for the engine; and, a vapor purge valve operatively connected to said upper end wall, said vapor purge valve having a first orifice inlet and a second orifice inlet, each of a preselected size through said upper end wall for communication with said first vapor chamber and said second vapor chamber, respectively, said vapor purge valve further having a vapor outlet with a purge orifice passage therein connectable to the induction system of the engine and, a vacuum actuated valve means controlling flow of vapor flowing through said first orifice inlet and said second orifice inlet to said vapor outlet, said first canister chamber being in flow communication with said second canister chamber via said atmospheric pressure chamber whereby to effectively reduce vapor back purge between said canister chambers during diurnal purge of vapor from the fuel tank.

2. An evaporative emission canister for use with a motor vehicle engine and the fuel system therefor to control emission of fuel vapors, said canister including a housing defined by a cylindrical outer wall, a closed lower end wall, an upper end wall and a cylindrical partition wall depending from said upper end wall; an air-vapor permeable support member operatively positioned to peripherally abut said outer wall in spaced apart relation to said lower end wall and to abut against the end of said partition wall opposite said upper end wall to define with said lower end wall an air chamber; said support member defining with said housing above said support member an inner canister chamber enclosed by said partition wall with said inner canister chamber containing vapor adsorbent material located to provide a first vapor chamber adjacent said upper end wall and an annular outer canister chamber containing vapor adsorbent material located to provide an annular second vapor chamber adjacent said upper end wall; air passage means operatively connected to said housing for supplying external air to said air chamber; a first vent passage in said upper end wall to said first vapor chamber adapted for connection to receive fuel vapors from the fuel bowl of the carburetor for the engine; a second vent passage in said upper end wall to said second vapor chamber adapted for connection to receive fuel vapors from the fuel tank for the engine; and, a vapor purge valve with a purge chamber therein operatively connected to said upper end wall, said end wall having a first orifice inlet and a second orifice inlet, each of a preselected size, for flow communication at one end with said purge chamber and for communication at their opposite ends with said first vapor chamber and said second vapor chamber, respectively, said vapor purge valve further having a vapor outlet with a purge orifice passage therein connectable to the induction system of the engine and an intake manifold actuated valve means controlling flow from said purge chamber to said vapor outlet, said first canister chamber being in flow communication with said second canister chamber via said atmospheric pressure chamber whereby to effectively reduce vapor back purge between said canister chambers during diurnal purge of vapor from the fuel tank.

3. An evaporative emission canister for use with a motor vehicle engine and the fuel system therefor to control emission of fuel vapors, said canister including a housing defined by a cylindrical outer wall, a closed lower end wall, an upper end wall and a cylindrical partition wall depending from said upper end wall; an air-vapor permeable support member operatively positioned to peripherally said outer wall in spaced apart relation to said lower end wall and to abut against the end of said partition wall opposite said upper end wall to define with said lower end wall an air chamber; said support member defining with said housing above said support member an inner canister chamber enclosed by said partition wall with said inner canister chamber containing vapor adsorbent material located to provide a first vapor chamber adjacent said upper end wall and an annular outer canister chamber containing vapor adsorbent material located to provide an annular second vapor chamber adjacent said upper end wall; air passage means operatively connected to said housing for supplying external air to said air chamber; a first vent passage in said upper end wall to said first vapor chamber adapted for connection to receive fuel vapors from the fuel bowl of the carburetor for the engine; a second vent passage in said upper end wall to said second vapor chamber adapted for connection to receive fuel vapors from the fuel tank for the engine; and, a vapor purge valve having a housing means associated with said upper end wall, said housing means having a diaphragm valve means operatively positioned therein to define a vacuum chamber on one side thereof connectable to a vacuum port of the engine and a purge chamber on the opposite side thereof, said housing means including an upstanding boss projecting into said purge chamber and defining at one end thereof valve seat means, a vapor outlet passage means including a purge orifice passage in said housing means extending at one end through said boss to be encircled by said valve seat means, said outlet vapor passage means being connectable at its opposite end to the induction system of the engine, a first orifice inlet in said housing means for effecting flow communication between said purge chamber and said first vapor chamber, and a purge passage means including a second orifice inlet from said second vapor chamber extending through said boss to have one end thereof encircled by said valve seat means, said valve seat means being positioned for engagement by said diaphragm valve means whereby said diaphragm valve means is normally operative to block flow between said purge chamber, said purge passage means and said vapor outlet passage means, said first canister chamber being in flow communication with said second canister chamber via said atmospheric pressure chamber whereby vapor back purging between said canister chambers will be substantially eliminated.

* * * * *

UNITED STATES PATENT AND TRADEMARK OFFICE

CERTIFICATE OF CORRECTION

PATENT NO. : 4,203,401

DATED : May 20, 1980

INVENTOR(S) : Charles A. Kingsley et al

It is certified that error appears in the above-identified patent and that said Letters Patent are hereby corrected as shown below:

Column 6, line 58, "passae" should read -- passage --.

Column 10, line 60, after "peripherally" insert -- abut --.

Signed and Sealed this

*Seventh* Day of *October 1980*

[SEAL]

*Attest:*

SIDNEY A. DIAMOND

*Attesting Officer*

*Commissioner of Patents and Trademarks*